US005612283A

United States Patent [19]

Campbell

[11] Patent Number: 5,612,283

[45] Date of Patent: Mar. 18, 1997

[54] DYE-RECEIVING ELEMENT FOR THERMAL DYE TRANSFER

[75] Inventor: Bruce C. Campbell, Rochester, N.Y.

[73] Assignee: Eastman Kodak Company, Rochester, N.Y.

[21] Appl. No.: 664,334

[22] Filed: Jun. 14, 1996

[51] Int. Cl.[6] ..... B41M 5/035; B41M 5/38

[52] U.S. Cl. ..... 503/227; 428/195; 428/213; 428/216; 428/304.4; 428/913; 428/914

[58] Field of Search ..... 8/471; 428/195, 428/212, 213, 216, 304.4, 523, 913, 914; 503/227

[56] References Cited

U.S. PATENT DOCUMENTS 5,244,861 9/1993 Campbell et al. ..... 503/227

*Primary Examiner*—B. Hamilton Hess

*Attorney, Agent, or Firm*—Harold E. Cole

[57] ABSTRACT

A dye-receiving element for thermal dye transfer comprising a support having on the front side thereof, in order, a biaxially-oriented composite film laminated thereto and a dye image-receiving layer, the composite film comprising a microvoided thermoplastic core layer and at least one substantially void-free thermoplastic surface layer, the support having on the back side thereof a biaxially-oriented transparent film laminated thereto which has a light transmission of at least 70%, the ratio of thickness of the transparent film to the composite film being from about 0.45 to about 0.75.

18 Claims, No Drawings

DYE-RECEIVING ELEMENT FOR THERMAL DYE TRANSFER

This invention relates to dye-receiving elements used in thermal dye transfer processes, and more particularly to dye-receiving elements containing microvoided composite films.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Dye-receiving elements used in thermal dye transfer generally comprise a polymeric dye image-receiving layer coated on a base or support. Transport through the thermal printer is very dependent on the base properties. For acceptable performance, the dye-receiving element must have low cud under a wide variety of environmental conditions, conditions at which the printer will be operating. From an aesthetics standpoint, it is also desirable for the dye-receiving element to exhibit low curl under the wide variety of environmental conditions at which the prim will be displayed or kept.

U.S. Pat. No. 5,244,861 describes a dye-receiving element for thermal dye transfer comprising a base having thereon a dye image-receiving layer, wherein the base comprises a composite film laminated to a cellulosic paper support, the dye image-receiving layer being on the composite film side of the base, and the composite film comprising a microvoided thermoplastic core layer having a stratum of voids therein and at least one substantially void-free thermoplastic surface (skin) layer. This dye-receiving element exhibits low curl and excellent printer performance at typical ambient conditions. There is a problem with this receiver under extreme environmental humidity conditions, however, when significant curl can be observed.

Example 6 of this patent also discloses that the composite film may be laminated to both sides of the support. There is a problem with that dye-receiving element in that the composite film laminated to the back side prevents printing on the paper support to be seen, since the composite film is opaque.

It is an object of this invention to provide a microvoided receiver for thermal dye transfer printing which has improved cud resistance under extreme environmental humidity conditions. It is a further object of the invention to provide a microvoided receiver for thermal dye transfer printing which enables back-printing on the support to be seen.

These and other objects are accomplished in accordance with the invention, which relates to a dye-receiving element for thermal dye transfer comprising a support having on the front side thereof, in order, a biaxially-oriented composite film laminated thereto and a dye image-receiving layer, the composite film comprising a microvoided thermoplastic core layer and at least one substantially void-free thermoplastic surface layer, the support having on the back side thereof a biaxially-oriented transparent film laminated thereto which has a light transmission of at least 70%, the ratio of thickness of the transparent film to the composite film being from about 0.45 to about 0.75.

The support used in the invention can be, for example, a polymeric, a synthetic paper, or a cellulose fiber paper support, such as a water leaf sheet of wood pulp fibers or alpha pulp fibers, etc.

In products made by a typical extrusion lamination process, back printing labels, water marks and logos are applied directly to the back side of the paper support stock with inks applied by a gravure printing process. It would be desirable to have such "back printing" indicia be visible.

The transparent film laminated to the back side of the support in the invention can be, for example, biaxially-oriented polyesters, biaxially-oriented polyolefin films such as polyethylene, polypropylene, polymethylpentene, and mixtures thereof. Polyolefin copolymers, including copolymers of ethylene and propylene are also useful. In a preferred embodiment, polypropylene is preferred. The thickness of the film can be from about 12 to about 75 μm. As noted above, the transparent film has a light transmission of at least 70%, i.e., at least 70% of visible light is transmitted by this film.

The transparent film can be laminated to the support using a tie layer such as a polyolefin such as polyethylene, polypropylene, etc., if desired.

As noted above, the ratio of thickness of the transparent film to the composite film is from about 0.45 to about 0.75. It was surprising to find that using a film on the back side, having a significantly different thickness than the film on the front side, would cause the humidity cud to be reduced. In addition, from a cost standpoint, thinner films are preferred since they tend to be less expensive.

Due to their relatively low cost and good appearance, composite films are generally used and referred to in the trade as "packaging films." The low specific gravity of microvoided packaging films (preferably between 0.3–0.7 g/cm$^3$) produces dye-receivers that are very conformable and results in low mottle-index values of thermal prints. These microvoided packaging films also are very insulating and produce dye-receiver prints of high dye density at low energy levels. The nonvoided skin produces receivers of high gloss and helps to promote good contact between the dye-receiving layer and the dye-donor film. This also enhances print uniformity and efficient dye transfer.

Microvoided composite packaging films are conveniently manufactured by coextrusion of the core and surface layers, with subsequent biaxial orientation, whereby voids are formed around void-initiating material contained in the core layer. Such composite films are disclosed in, for example, U.S. Pat. No. 4,377,616, the disclosure of which is incorporated by reference.

The core of the composite film should be from 15 to 95% of the total thickness of the film, preferably from 30 to 85% of the total thickness. The nonvoided skin(s) should thus be from 5 to 85% of the film, preferably from 15 to 70% of the thickness. The density (specific gravity) of the composite film should be between 0.2 and 1.0 g/cm$^3$, preferably between 0.3 and 0.7 g/cm$^3$. As the core thickness becomes less than 30% or as the specific gravity is increased above 0.7 g/cm$^3$, the composite film starts to lose useful compressibility and thermal insulating properties. As the core thickness is increased above 85% or as the specific gravity becomes less than 0.3 g/cm$^3$, the composite film becomes less manufacturable due to a drop in tensile strength and it becomes more susceptible to physical damage. The total thickness of the composite film can range from 20 to 150 μm, preferably from 30 to 70 μm. Below 30 μm, the microvoided films may not be thick enough to minimize any inherent non-planarity in the support and would be more difficult to manufacture. At thicknesses higher than 70 μm, little improvement in either print uniformity or thermal efficiency are seen, and so there is little justification for the further increase in cost for extra materials.

Suitable classes of thermoplastic polymers for the core matrix-polymer of the composite film include polyolefins, polyesters, polyamides, polycarbonates, cellulosic esters, polystyrene, polyvinyl resins, polysulfonamides, polyethers, polyimides, poly(vinylidene fluoride), polyurethanes, poly(phenylene sulfides), polytetrafluoroethylene, polyacetals, polysulfonates, polyester ionomers, and polyolefin ionomers. Copolymers and/or mixtures of these polymers can be used. Suitable polyolefins for the core matrix-polymer of the composite film include polypropylene, polyethylene, polymethylpentene, and mixtures thereof. Polyolefin copolymers, including copolymers of ethylene and propylene are also useful.

Suitable polyesters for the core matrix-polymer of the composite film include those produced from aromatic, aliphatic or cycloaliphatic dicarboxylic acids of 4–20 carbon atoms and aliphatic or alicyclic glycols having from 2–24 carbon atoms. Examples of suitable dicarboxylic acids include terephthalic, isophthalic, phthalic, naphthalenedicarboxylic acids, succinic, glutaric, adipic, azelaic, sebacic, fumaric, maleic, itaconic, 1,4-cyclohexanedicarboxylic, sodiosulfoisophthalic acids and mixtures thereof. Examples of suitable glycols include ethylene glycol, propylene glycol, butanediol, pentanediol, hexanediol, 1,4-cyclohexanedimethanol, diethylene glycol, other polyethylene glycols and mixtures thereof. Such polyesters are well known in the art and may be produced by well known techniques, e.g., those described in U.S. Pat. Nos. 2,465,319 and 2,901,466. Preferred continuous matrix polyesters are those having repeat units from terephthalic acid or naphthalenedicarboxylic acid and at least one glycol selected from ethylene glycol, 1,4-butanediol and 1,4-cyclohexanedimethanol. Poly(ethylene terephthalate), which may be modified by small amounts of other monomers, is especially preferred. Other suitable polyesters include liquid crystal copolyesters formed by the inclusion of suitable amounts of a co-acid component such as stilbenedicarboxylic acid. Examples of such liquid crystal copolyesters are those disclosed in U.S. Pat. Nos. 4,420,607; 4,459,402 and 4,468,510.

Useful polyamides for the core matrix-polymer of the composite film include Nylon 6, Nylon 66, and mixtures thereof. Copolymers of polyamides are also suitable continuous phase polymers. An example of a useful polycarbonate is bisphenol-A polycarbonate. Cellulosic esters suitable for use as the continuous phase polymer of the composite films include cellulose nitrate, cellulose triacetate, cellulose diacetate, cellulose acetate propionate, cellulose acetate butyrate, and mixtures or copolymers thereof. Useful polyvinyl resins include poly(vinyl chloride), poly(vinyl acetal), and mixtures thereof. Copolymers of vinyl resins can also be utilized.

The nonvoided skin layers of the composite film can be made of the same polymeric materials as listed above for the core matrix. The composite film can be made with skin(s) of the same polymeric material as the core matrix, or it can be made with skin(s) of different polymeric composition than the core matrix. For compatibility, an auxiliary layer can be used to promote adhesion of the skin layer to the core.

Addenda may be added to the core matrix and/or to the skins to improve the whiteness of these films. This would include any process which is known in the art including adding a white pigment, such as titanium dioxide, barium sulfate, clay, or calcium carbonate. This would also include adding fluorescing agents which absorb energy in the UV region and emit light largely in the blue region, or other additives which would improve the physical properties of the film or the manufacturability of the film.

The coextrusion, quenching, orienting, and heat setting of these composite films may be effected by any process which is known in the art for producing oriented film, such as by a flat film process or a bubble or tubular process. The flat film process involves extruding the blend through a slit die and rapidly quenching the extruded web upon a chilled casting drum so that the core matrix polymer component of the film and the skin components(s) are quenched below their glass transition temperatures (Tg). The quenched fill is then biaxially oriented by stretching in mutually perpendicular directions at a temperature above the glass transition temperature of the matrix and skin polymers. The film may be stretched in one direction and then in a second direction or may be simultaneously stretched in both directions. After the film has been stretched it is heat-set by heating to a temperature sufficient to crystallize the polymers while restraining to some degree the film against retraction in both directions of stretching.

These composite films may be coated or treated, after the coextrusion and orienting processes or between casting and full orientation, with any number of coatings which may be used to improve the properties of the films including printability, to provide a vapor barrier, to make them heat sealable, or to improve adhesion to the support or to the receiver layers. Examples of this would be acrylic coatings for printability, coating poly(vinylidene chloride) for heat seal properties, or corona discharge treatment to improve printability or adhesion.

By having at least one nonvoided skin on the microvoided core, the tensile strength of the film is increased and makes it more manufacturable. It allows the films to be made at wider widths and higher draw ratios than when films are made with all layers voided. Coextruding the layers further simplifies the manufacturing process.

It is preferable to extrusion laminate the microvoided composite films using a polyolefin resin onto the paper support. During the lamination process, it is desirable to maintain minimal tension of the microvoided packaging film in order to minimize cud in the resulting laminated receiver support.

In one preferred embodiment, in order to produce receiver elements with a desirable photographic look and feel, it is preferable to use relatively thick paper supports (e.g., at least 120 μm thick, preferably from 120 to 250 μm thick) and relatively thin microvoided composite packaging films (e.g., less than 50 μm thick, preferably from 20 to 50 μm thick, more preferably from 30 to 50 μm thick).

The dye image-receiving layer of the receiving elements of the invention may comprise, for example, a polycarbonate, a polyurethane, a polyester, poly(vinyl chloride), poly(styrene-co-acrylonitrile), polycaprolactone or mixtures thereof. The dye image-receiving layer may be present in any amount which is effective for the intended purpose. In general, good results have been obtained at a concentration of from about 1 to about 10 g/m$^2$. An overcoat layer may be further coated over the dye-receiving layer, such as described in U.S. Pat. No. 4,775,657, the disclosure of which is incorporated by reference.

Dye-donor elements that are used with the dye-receiving element of the invention conventionally comprise a support having thereon a dye-containing layer. Any dye can be used in the dye-donor employed in the invention provided it is transferable to the dye-receiving layer by the action of heat. Especially good results have been obtained with sublimable dyes. Dye donors applicable for use in the present invention are described, e.g., in U.S. Pat. Nos. 4,916,112; 4,927,803 and 5,023,228, the disclosures of which are incorporated by reference.

As noted above, dye-donor elements are used to form a dye transfer image. Such a process comprises imagewise-heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of cyan, magenta and yellow dye, and the dye transfer steps are sequentially performed for each color to obtain a three-color dye transfer image. Of course, when the process is only performed for a single color, then a monochrome dye transfer image is obtained.

Thermal printing heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2OO8-F3. Alternatively, other known sources of energy for thermal dye transfer may be used, such as lasers as described in, for example, GB No. 2,083,726A.

A thermal dye transfer assemblage of the invention comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following example is provided to further illustrate the invention.

EXAMPLE

A. Paper Support Stock

A 1:1 blend of Pontiac Maple 51 (a bleached maple hardwood kraft of 0.5 μm length weighted average fiber length) available from Consolidated Pontiac, Inc., and Alpha Hardwood Sulfite (a bleached red-alder hardwood sulfite of 0.69 μm average fiber length), available from Weyerhauser Paper Co., 137 μm thick, was used in all examples except Invention Example 1. The paper stock used for Invention Example 1 was 157 μm thick and made from a 100% hardwood Kraft pulp blend. The paper stocks were back primed with a logo.

The films shown in Table 1 were laminated to the opposite or back side of the paper stock. The % light transmission values were measured by an XL-211 Haze Meter (BYK Gardner, Silver Spring, Md.). The back side film should be non-opaque or have a light transmission value of 70% or higher to ensure that the back printing on the paper stock can be read.

TABLE 1

| Example | Back side Film* | Film Thickness (μm) | % Light Transmission |
|---|---|---|---|
| Invention 1 | BICOR ® 70 MLT | 18 | 92 |
| Invention 2 | BICOR ® 318 ASB | 22 | 93 |
| Invention 3 | BICOR ® LBW 100 | 25 | 93 |
| Control 1 | PROCOR ® 60 PAC | 15 | 94 |
| Control 2 | OPPalyte ® 370 HSW | 28 | 41 |
| Control 3 | OPPalyte ® 350 TWK | 37 | 21 |
| Control 4 | OPPalyte ® 350 K18 | 37 | 21 |

*all back side films were polypropylene (Mobil Chemical Co.) and are described in a brochure entitled "Mobil Flexible Packing Films Product Characteristics" (September 1995).

The above results show that the invention examples and Control 1 all have good light transmission values so that the back-printing on the paper stock could be read. However, Control 1 has another problem as shown hereafter.

B. Preparation of the Microvoided Support

Receiver support examples were prepared in the following manner. A Commercially available packaging film (OPPalyte® K18 TWK made by Mobil Chemical Co.) was laminated to the front side of the paper stocks described above. OPPalyte® K18 TWK is a composite film (37 μm thick) (d=0.62) consisting of a microvoided and oriented polypropylene core (approximately 73% of the total film thickness), with a titanium dioxide pigmented non-microvoided oriented polypropylene layer on each side; the void-initiating material is poly(butylene terephthalate). Reference is made to U.S. Pat. No. 5,244,861 where details for the production of this laminate are described.

Packaging films may be laminated in a variety of ways (by extrusion, pressure, or other means) to a paper support. In the present example, the polymer films were extrusion laminated as described below with pigmented polyolefin onto the front side of the paper stock support. The pigmented polyolefin was polyethylene (12 g/m$^2$) containing anatase titanium dioxide (12.5% by weight) and a benzoxazole optical brightener (0.05% by weight). The back side films were also extrusion laminated to the opposite side of the paper stock support with clear high density polyethylene (12 g/m$^2$).

Control 5 was prepared in a similar manner as described above except that no film was applied to the back side of the paper stock support. In this example, the back side was extrusion coated with high density polyethylene (30 g/m$^2$).

C. Preparation of Thermal Dye Transfer Receiving Elements

Thermal dye-transfer receiving elements were prepared from the above receiver supports by coating the following layers in order on the top surface of the microvoided packaging film:

a) a subbing layer of Prosil® 221 and Prosil® 2210 (PCR, Inc.) (1:1 weight ratio) both are amino-functional organo-oxysilanes, in an ethanol-methanol-water solvent mixture. The resultant solution (0.10 g/m$^2$) contained approximately 1% of silane component, 1% water, and 98% of 3A alcohol;

b) a dye-receiving layer containing Makrolone KL3-1013 (a polyether-modified bisphenol-A polycarbonate block copolymer) (Bayer AG) (1.82 g/m$^2$), GE Lexan® 141-112 (a bisphenol-A polycarbonate) (General Electric Co.) (1.49 g/m$^2$), and Fluorad® FC-43 1 (perfluorinated alkylsulfonamidoalkyl ester surfactant) (3M Co.) (0.011 g/m$^2$), di-n-butyl phthalate (0.33 g/m$^2$), and diphenyl phthalate (0.33 g/m$^2$) and coated from a solvent mixture of methylene chloride and trichloroethylene (4:1 by weight) (4.1% solids);

c) a dye-receiver overcoat containing a solvent mixture of methylene chloride and trichloroethylene; a polycarbonate random terpolymer of bisphenol-A (50 mole %), diethylene glycol (93.5 wt %) and polydimethylsiloxane (6.5 wt. %) 2500 MW) block units (50% mole % ) (0.65 g/m$^2$) and surfactants DC-510 Silicone Fluid (Dow-Corning Corp.) (0.008 g/m$^2$), and Fluorad® FC-43 1 (3M Co.) (0.016 g/m$^2$) from dichloromethane.

D. Curl Measurements on Test Examples

Test examples were conditioned for one week at both 5% RH/23° C. and 85% RH/23° C., after which curl measurements were made. The test examples were 21.6 cm×27.9 cm in size (27.9 cm in the machine direction).

After conditioning, the examples were placed on a flat surface with the curled edges pointing away from the flat surface. Using a ruler, the height (measured to the nearest 0.16 cm) of each corner above the flat surface was measured. The four heights were averaged together to give a single edge rise curl value. A positive curl value indicates curl toward the face or dye-receiving layer side. A negative curl value indicates curl toward the back side. For comparison purposes, the cuff difference between 85% RH/23° C. and 5% RH/23° C. is given to represent total curl performance (smaller differences mean lower curl over this range). This cuff method is based on TAPPI Test Method T 520 cm-85. Cuff difference values of 15 mm or less are considered good for humidity cuff. The following results were obtained:

TABLE 2

| Example | Back Side/ Front Side Film Thickness Ratio* | Edge Rise Curl At 5% RH, 23° C. (mm) | Edge Rise Curl At 85% RH, 23° C. (mm) | Curl Difference 85%–5% RH (mm) |
|---|---|---|---|---|
| Invention 1 | 0.49 | 5.3 | 7.9 | 2.6 |
| Invention 2 | 0.59 | −7.6 | −6.9 | 0.7 |
| Invention 3 | 0.68 | −12.2 | −20.6 | −8.4 |
| Control 1 | 0.41 | −7.6 | 13.0 | 20.6 |
| Control 2 | 0.76 | −5.8 | −6.1 | −0.3 |
| Control 3 | 1.00 | −10.7 | −9.9 | 0.8 |
| Control 4 | 1.00 | −10.7 | −7.1 | 3.6 |
| Control 5 | no back side film | −69.3 | 10.4 | 79.7 |

*back side film thicknesses of Table 1 divided by 37

The above results show that the thermal dye transfer receiving elements made with supports of the invention, which have a back side/front side film thickness ratio of 0.45 to 0.75, have good cud control. Control 1, which had good light transmission as shown in the previous Table 1, had poor cud control. While Controls 2–4 also had good cud control, they had poor light transmission as shown in Table 1. Only the thermal dye transfer receiving elements made with supports having the films laminated thereto in accordance with the invention had both good light transmission and good cud control.

The invention has been described in detail with particular reference to preferred embodiments thereof, but it will be understood that variations and modifications can be effected within the spirit and scope of the invention.

What is claimed is:

1. A dye-receiving element for thermal dye transfer comprising a support having on the front side thereof, in order, a biaxially-oriented composite film laminated thereto and a dye image-receiving layer, said composite film comprising a microvoided thermoplastic core layer and at least one substantially void-free thermoplastic surface layer, said support having on the back side thereof a biaxially-oriented transparent film laminated thereto which has a light transmission of at least 70%, the ratio of thickness of said transparent film to said composite film being from about 0.45 to about 0.75.

2. The element of claim 1 wherein said transparent film is polypropylene.

3. The element of claim 1 wherein the thickness of said composite film is from 30 to 70 μm.

4. The element of claim 1 wherein said core layer of said composite film comprises from 30 to 85% of the thickness of said composite film.

5. The element of claim 1 wherein said microvoided thermoplastic core layer has a substantially void-free thermoplastic surface layer on each side thereof.

6. The element of claim 1 wherein said microvoided thermoplastic core layer comprises oriented polypropylene having on each side thereof a substantially void-free thermoplastic surface layer of oriented polypropylene.

7. A process of forming a dye transfer image comprising:

a) imagewise-heating a dye-donor element comprising a support having thereon a dye layer comprising a dye dispersed in a binder, and b) transferring a dye image to a dye-receiving element to form said dye transfer image, wherein said dye-receiving element comprises a support having on the front side thereof, in order, a biaxially-oriented composite film laminated thereto and a dye image-receiving layer, said composite film comprising a microvoided thermoplastic core layer and at least one substantially void-free thermoplastic surface layer, said support having on the back side thereof a biaxially-oriented transparent film laminated thereto which has a light transmission of at least 70%, the ratio of thickness of said transparent film to said composite film being from about 0.45 to about 0.75.

8. The process of claim 7 wherein said transparent film is polypropylene.

9. The process of claim 7 wherein the thickness of said composite film is from 30 to 70 μm.

10. The process of claim 7 wherein said core layer of said composite film comprises from 30 to 85 % of the thickness of said composite film.

11. The process of claim 7 wherein said microvoided thermoplastic core layer has a substantially void-free thermoplastic surface layer on each side thereof.

12. The process of claim 7 wherein said microvoided thermoplastic core layer comprises oriented polypropylene having on each side thereof a substantially void-free thermoplastic surface layer of oriented polypropylene.

13. A thermal dye transfer assemblage comprising:

a) a dye-donor element comprising a support having thereon a dye layer comprising a dye dispersed in a binder, and b) a dye-receiving element comprising a support having thereon a dye image-receiving layer, said dye-receiving element being in a superposed relationship with said dye-donor element so that said dye layer is in contact with said dye image-receiving layer, wherein said dye-receiving element comprises a support having on the front side thereof, in order, a biaxially-oriented composite film laminated thereto and said dye image-receiving layer, said composite film comprising a microvoided thermoplastic core layer and at least one substantially void-free thermoplastic surface layer, said support having on the back side thereof a biaxially-oriented transparent film laminated thereto which has a light transmission of at least 70%, the ratio of thickness of said transparent film to said composite film being from about 0.45 to about 0.75.

14. The assemblage of claim 13 wherein said transparent film is polypropylene.

15. The assemblage of claim 13 wherein the thickness of said composite film is from 30 to 70 μm.

16. The assemblage of claim 13 wherein said core layer of said composite film comprises from 30 to 85% of the thickness of said composite film.

17. The assemblage of claim 13 wherein said microvoided thermoplastic core layer has a substantially void-free thermoplastic surface layer on each side thereof.

18. The assemblage of claim 13 wherein said microvoided thermoplastic core layer comprises oriented polypropylene having on each side thereof a substantially void-free thermoplastic surface layer of oriented polypropylene.

* * * * *